US008864188B2

(12) United States Patent
Redgrave

(10) Patent No.: US 8,864,188 B2
(45) Date of Patent: Oct. 21, 2014

(54) CLOSURE MECHANISM

(76) Inventor: Roderick Nigel Redgrave, Waitakere (NZ)

( * ) Notice: Subject to any disclaimer, the term of this patent is extended or adjusted under 35 U.S.C. 154(b) by 588 days.

(21) Appl. No.: 12/993,331

(22) PCT Filed: May 20, 2009

(86) PCT No.: PCT/NZ2009/000082
§ 371 (c)(1),
(2), (4) Date: Nov. 18, 2010

(87) PCT Pub. No.: WO2009/142513
PCT Pub. Date: Nov. 26, 2009

(65) Prior Publication Data

US 2011/0080009 A1 Apr. 7, 2011

(30) Foreign Application Priority Data

May 20, 2008 (NZ) ..... 568456

(51) Int. Cl.
*E05C 17/56* (2006.01)
*E05C 19/16* (2006.01)

(52) U.S. Cl.
CPC ..... *E05C 19/16* (2013.01); *Y10S 292/10* (2013.01); *Y10S 292/04* (2013.01); *Y10S 292/15* (2013.01)
USPC ..... 292/251.5; 292/DIG. 10; 292/DIG. 4; 292/DIG. 15

(58) Field of Classification Search
USPC ..... 292/251.5
See application file for complete search history.

(56) References Cited

U.S. PATENT DOCUMENTS

| | | | | | |
|---|---|---|---|---|---|
| 2,673,377 | A * | 3/1954 | Gaugler | 49/503 |
| 2,906,553 | A * | 9/1959 | Wilson | 292/251.5 |
| 2,970,857 | A | 2/1961 | Squire | |
| 3,258,285 | A | 6/1966 | Smith | |
| 3,288,511 | A * | 11/1966 | Tavano | 292/251.5 |
| 3,533,652 | A * | 10/1970 | Crane et al. | 292/251.5 |
| 3,600,025 | A | 8/1971 | Brainard | |
| 3,934,909 | A | 1/1976 | Van Natter | |
| 4,155,576 | A | 5/1979 | Kennon | |
| 4,434,524 | A | 3/1984 | Gilchrist | |
| 4,654,929 | A * | 4/1987 | Fahnders et al. | 16/261 |
| 4,995,655 | A * | 2/1991 | Freeman | 292/251.5 |
| 5,758,913 | A * | 6/1998 | Roth et al. | 292/251.5 |
| 5,887,917 | A * | 3/1999 | Luciana | 292/251.5 |
| 6,215,381 | B1 * | 4/2001 | Aoki | 335/207 |
| 6,658,697 | B2 * | 12/2003 | Liao | 16/82 |
| 2007/0007775 | A1 * | 1/2007 | Gallas et al. | 292/251.5 |

FOREIGN PATENT DOCUMENTS

| | | |
|---|---|---|
| DE | 102004054028 | 5/2006 |
| GB | 1530591 | 11/1978 |

OTHER PUBLICATIONS

John Ho, International Search Report in PCT/NZ2009/000082, Sep. 8, 2009, 5 pages, Australian Patent Office, Woden, Australia.
John Ho, Written Opinion of the International Searching Authority in PCT/NZ2009/000082, Sep. 8, 2009, 8 pages, Australian Patent Office, Woden, Australia.
John Ho, International Preliminary Report on Patentability in PCT/NZ2009/000082, May 31, 2010, 10 pages, Australian Patent Office, Woden, Australia.

* cited by examiner

*Primary Examiner* — Mark Williams
(74) *Attorney, Agent, or Firm* — Florek & Endres PLLC

(57) ABSTRACT

A closure mechanism and in particular to a magnetically operated closure mechanism for doors and the like which includes a first and second magnetic assembly, each of said magnetic assembly comprising a magnet; and a housing to house the magnet, wherein at least one magnetic assembly includes an adjustment mechanism to adjust the position of the magnet relative to its housing.

14 Claims, 7 Drawing Sheets

CLOSURE MECHANISM

This application is a U.S. National Stage filing under 35 U.S.C. §371 of International Application No. PCT/NZ2009/000082, filed May 20, 2009, which in turn claims priority to New Zealand Patent Application No. 568456, filed May 20, 2008.

TECHNICAL FIELD

The present invention relates to a closure mechanism and in particular to a magnetically operated closure mechanism for doors and the like.

BACKGROUND ART

In general, door assemblies contain a number of components including a frame, a door configured to fully or partially fill the aperture created by the frame, a hinging mechanism to both retain the door within the frame and facilitate movement of the door relative to the frame, and a closure mechanism for retaining the door in the closed position within the frame. Depending on the function and type of door these components can vary. For example, a cupboard door may be attached directly to the side panels of a cabinet and not require a separate frame member.

As aforesaid, a closing mechanism mounted in the door retains the door in its closed position and prevents the door from opening unexpectedly. One commonly used closure mechanism is a latch retained within a housing and operatively connected to a handle. The housing is inset into the side edge of a door and the latch is biased by a spring into a position whereby it extends from the housing. Rotational movement of the handle causes the latch to retract against the spring into the housing. As the latch is biased by the spring, releasing the handle causes the latch to revert to its extended position. The frame of the door is fitted with a recess adapted to receive the latch. Thus, when the door is closed, the latch is retained in the recess by the biasing spring, preventing the door from opening until the latch is retracted via the handle.

Such closure mechanisms can be used in combination with a lock to prevent opening of the door. For example, a closure mechanism in the form of a spring operated latch as previously described may be coupled with a separate dead bolt. Sliding the dead bolt into the frame will prevent the door from opening even if the spring operated latch is disengaged. More often the lock will be coupled directly to, or form a part of, the closure mechanism such that enabling the lock restricts operation of the closure mechanism. For example, a closure mechanism in the form of a spring operated latch as previously described may be coupled with a means for restricting movement of the handle.

One disadvantage of common closing mechanisms is the large number of moving parts in the mechanism which may fail after continued use. In the event of a failure of the handle for example, if the door is closed the latch will be biased toward the recess in the door frame and there may be no easy means for retracting it so as to open the door without damaging the door, the latch and/or the door frame.

In order to reduce the large number of moving parts associated with closing mechanisms which can fail due to wear and tear, locking devices using magnets for closing doors are also known, some of which are disclosed in the following publications:

U.S. Pat. No. 3,600,025 discloses a releasable magnetic latch especially suitable for cabinet doors and the like having a spring means to be biased upon manual engagement and urging of the cabinet door inwardly from its normal closed position and to urge the door outwardly into an open position and past the range of the magnetic latching effect when the door is suddenly released from said manual engagement.

U.S. Pat. No. 3,934,909 discloses a push releasable magnetic latch for cupboard doors or the like, comprising a first magnetic member secured to the cupboard door and a second magnetic member swing mounted to the cupboard structure about a pivot axis perpendicular to the path of travel of the door. The second member has a forward latching position and a rearward non-latching position, with a spring pushing the second member to its forward latching position. To open the door, the door is pushed inwardly to force the second magnetic member to its non-latching position where the two magnetic members are out of engagement, after which the door is abruptly released so that the spring causes the second member to push the door outwardly away from the cupboard structure.

As the magnetic catches discussed above (and other types of magnetic/spring etc catches known in the prior art) have components that are surface mounted onto the door and door frame/jamb i.e. not hidden when the door is closed, there are many instances where these types of catches are not a suitable fitting. For example, double doors into a lounge area, or a single door into a room where the main components of the catch (normally a plastic rectangular shape box or a metal unit) is exposed and is considered too unsightly when viewed from inside the room.

Other types of prior art devices include concealed spring loaded roller and ball catches. However, these types of catches tend to be labour intensive to install, and as aforementioned have moving parts that wear out and require adjustment over time and are considered noisy during operation.

While there are prior art devices capable of performing the push releasable latching function as described above, there are continuing efforts to devise improved magnetic latching assemblies. From the above, it appears that the current magnetic latch technology is simple enough and easy to install in theory, but in practice a few problems present themselves.

For example, it can be difficult to drill holes for installation of a magnetic latching assembly in a neat and tidy fashion as to give sufficient holding power large magnets must be used and the holes for locating and housing the magnets must be similarly large. Furthermore, the wood types used for internal joinery are normally soft (in New Zealand, pine is mainly used) which often results in an oval hole with chips around the edges rather than a round hole. This leads to a poor quality finish which is visible when the door is open. This is not typically a problem for other kinds of closure mechanisms as they will usually have a plate or flange that covers the hole that is recessed into the wood.

It also can be difficult to precisely align and drill holes to align magnets as the installer is often drilling overhead or on top of a ladder which results in a substandard finish and fitting. In some instances, such as the installation of heavy double glass hallway doors, the magnets need to be installed with minimal distance between them for maximum attraction and power. If the magnets are not parallel to each other, a minimal distance can not be achieved as described further below.

A specific type of magnetic closure system involves flush mounting the magnets with respect to the surface of a door jamb and the top of a door. This mounting configuration of the magnets is desirable for aesthetic appeal.

However, it can be difficult to install the magnets with a minimum exposure or optimum depth (i.e. flush mounted) in some situations for example when installing magnets on double doors. In double door applications the size of the gap between the door and the frame of one door may differ from that of the other which would result in a different attractive force between the magnets on the respective doors if both were flush mounted. This would manifest itself in one door being easier (or harder) to open relative to the other. Also, if the closure mechanism of one of the doors is weaker, the weaker door may open when the other door is shut due to the air pressure effect inside a cupboard, room or the like.

Therefore, it is an object of the present invention to provide a magnetic closure assembly which is inexpensive to manufacture, easy to install and capable of adjustment and which addresses the foregoing problems or at least provides the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although prior art publications are referred to herein, this reference does not constitute an admission that any of these documents form part of the common general knowledge in the art, in New Zealand or in any other country.

It is acknowledged that the term 'comprise' or grammatical variations thereof may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

According to one aspect of the present invention there is provided a closure mechanism which includes a first and second magnetic assembly, each of said magnetic assemblies comprising;

a magnet; and a housing to house the magnet, wherein at least one magnetic assembly includes an adjustment mechanism to adjust the position of the magnet relative to its housing.

In preferred embodiments the magnetic assemblies are mounted within a door and a door frame such that the magnetic assemblies are offset and adjacent each other when the door is closed.

BRIEF DESCRIPTION OF DRAWINGS

Further aspects of the present invention will become apparent from the following description which is given by way of example only and with reference to the accompanying drawings in which.

DETAILED DESCRIPTION INCLUDING BEST MODES

Figure 1:
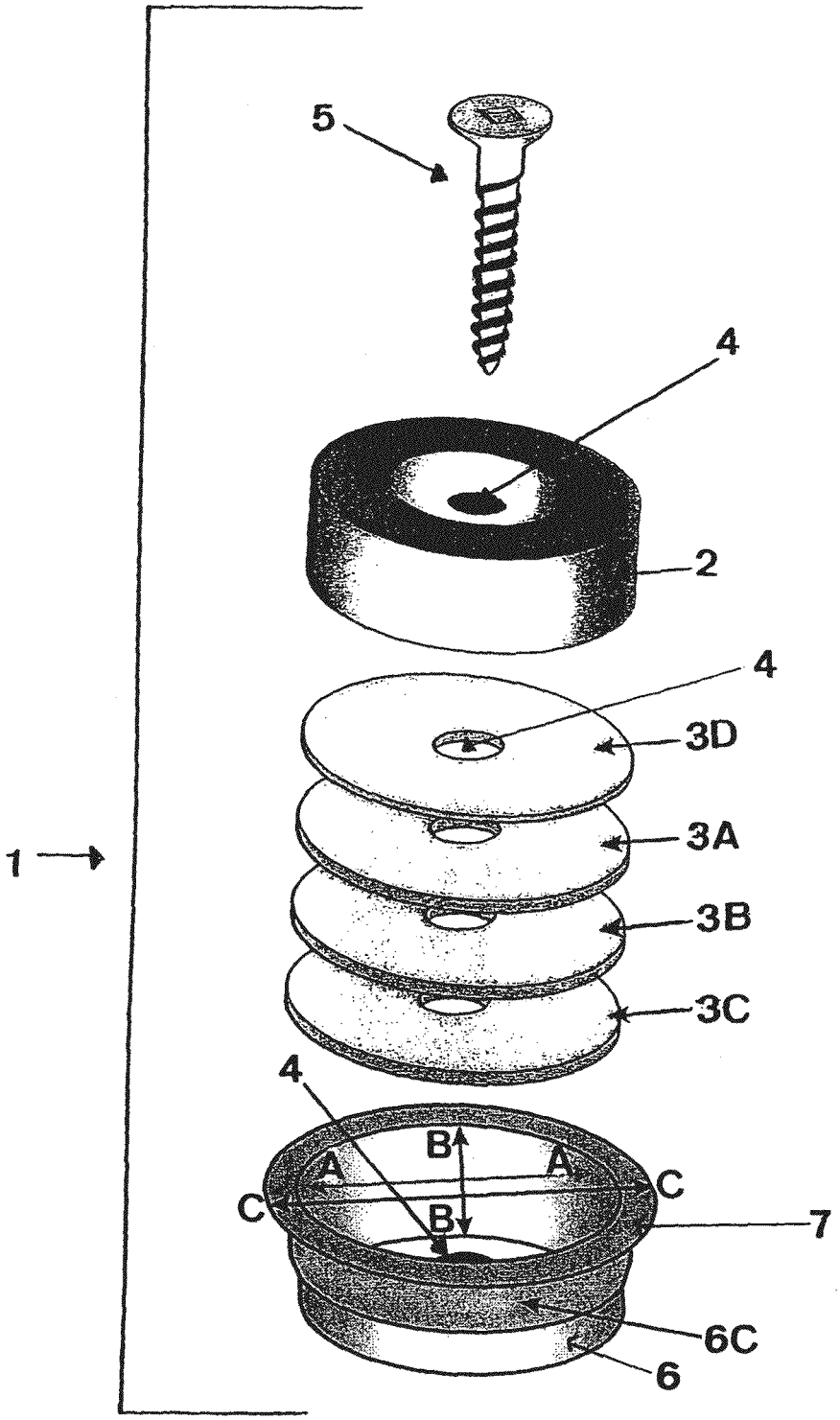
FIG. 1 shows a diagrammatic representation of a perspective view of one preferred embodiment of the present invention, a magnetic assembly prior to installation.
Figure 2:
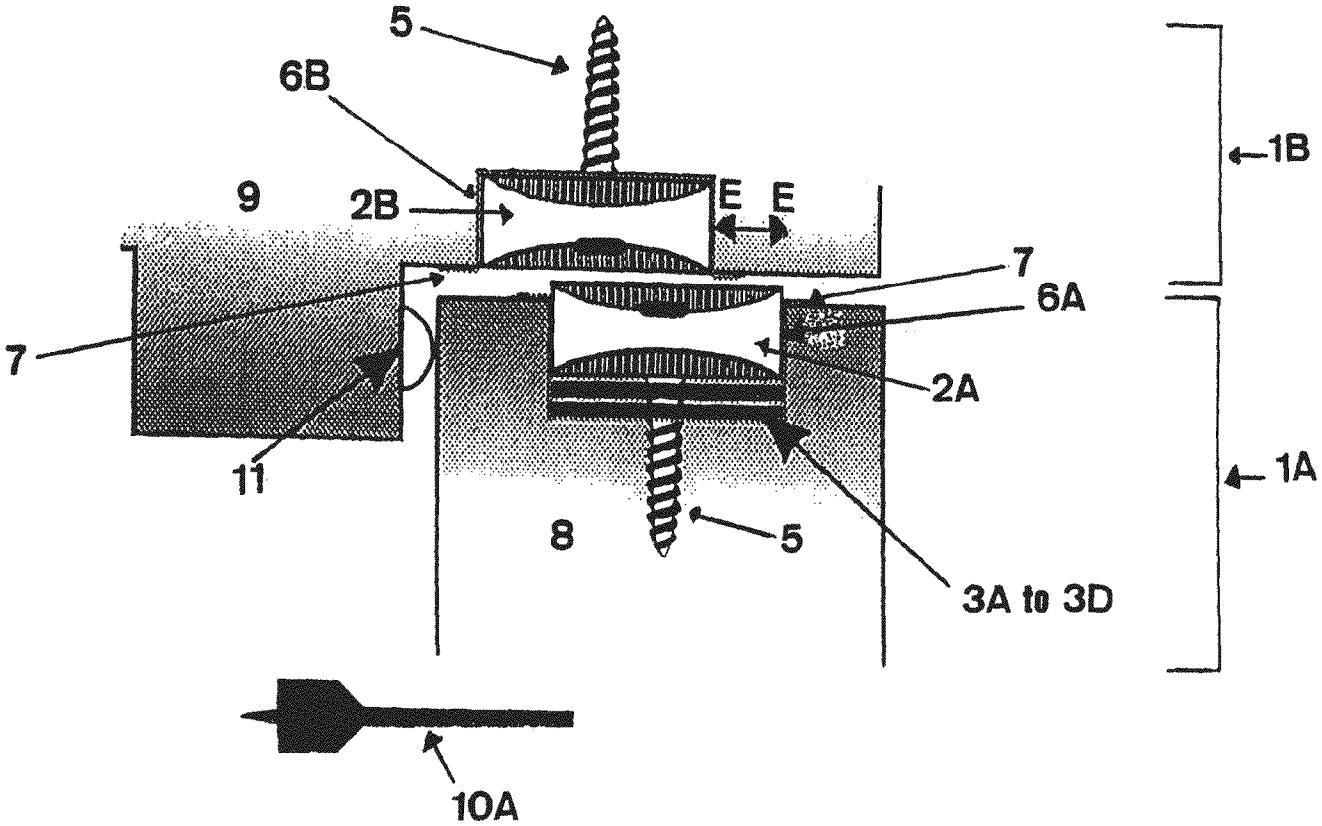
FIG. 2 shows a diagrammatic representation of a cutaway side profile of the embodiment shown in FIG. 1 wherein the magnetic assemblies have been installed into a door and door frame.

The invention is now described in relation to a preferred embodiment of the present invention as shown in FIGS. 1 and 2. It should be appreciated that the invention may be varied from the Figures without departing from the scope of the invention.

Referring to FIG. 1, a magnetic assembly of the present invention is generally indicated by arrow (1). In this embodiment, the magnetic assembly (1) includes a magnet (2), three spacer washers (3A, 3B and 3C) of diameter 22 mm and thickness 1 mm and a fourth spacer washer (3D) of diameter 22 mm and thickness 0.5 mm.

In preferred embodiments, the spacer washers (3A to 3D) include an aperture (4) of diameter 7 mm to receive a fastening device such as a screw (5). A preferred screw is a 305 stainless steel screw which is self tapping (8 g×1½", 2" square drive).

Preferably, the magnet (2) is circular with external diameter 22 mm and includes an aperture (4) as previously described to also receive the screw (5).

Throughout the present specification the term 'magnet' should be understood to mean a material or object that produces a magnetic field and that stays magnetised i.e. a permanent magnet. However, this should not be seen as a limitation on the embodiments envisaged for this invention as electromagnets that generate a magnetic field when an electric current is applied could conceivably be used with this invention.

It should be further appreciated that the first and second magnetic assemblies of the present invention are paramagnetic and oriented such that they attract each other in order for the magnets to operate as a closure means.

The magnetic assembly (1) also includes a magnet housing (6) of diameter 22 mm when measured through points A-A and depth of 8 mm when measured through points B-B.

In preferred embodiments the housing (6) is configured with a protrusion (7) extending from the top of, and perpendicular to, the side wall of the housing (6).

Preferably, the protrusion may be a flange or lip.

More preferably, the housing (6) is configured with a flange or lip (7) of external diameter 29 mm when measured through points C-C.

The advantage of flange or lip (7) is that it at least partially conceals the side edge of the hole drilled in the door or frame to receive the housing (in the manner described subsequently in this specification). Therefore, it is not essential that the hole is:

a) drilled in a neat and tidy fashion when drilling into soft wood as the flange will cover the edge from sight;
b) drilled square to the surface as the housing will always sit flush and parallel to the surface (owing to the flange) provided the hole is large enough to receive the housing in a position perpendicular to the edge of the door or frame which receives the housing; and
c) drilled at a precise depth. For example, if the hole is drilled too deep, the flange will abut the surface of the door or frame and prevent further insertion of the housing into the hole, thereby ensuring that the top of the housing is always substantially flush with the surface it is inserted into.

For ease of reference the magnet housing (6) shall now be simply referred to as a 'housing'.

More preferably, the housing includes an aperture (4) to also receive the screw (5).

In preferred embodiments the housing (6) is configured with a spacer ring (6C) which may be fitted to the external diameter of the housing under the protrusion (7).

Preferably, the spacer ring may be manufactured from plastic with a depth of 2 mm and internal/external diameters of 22.5 mm/24.11 mm respectively.

The advantage of a magnetic housing equipped with spacer ring is that it enables the housing to fit tightly into a hole drilled during installation. It also protects the housing from working loose over time and assists the installation procedure by holding the housing in place without screws. Furthermore, the housing will sit flat and square to the surface, even if the hole is drilled on an angle, as only the top 2 mm of the spacer ring is touching the sides of the hole.

FIG. 2 shows the first and second magnetic assemblies (1A and 1B) when installed in a door (8) and door frame (9). The first magnetic assembly (1A) is mounted in the top of the door (8) and the second magnetic assembly (1B) in a corresponding area of the door jamb (9) when the door (8) is in the closed position. The flange of the housings (6A and 6B) abuts the door (8) and jamb (7) respectively. A screw (5) passes through an aperture in the magnet (2A), spacer washers (3A to 3D) and door (8) to retain the first magnetic assembly (1A) within the door (8). The spacer washers (3A to 3D) are inserted in the first magnetic assembly (1A) to achieve the desired range of adjustment. A further screw (5) passes through an aperture in the magnet (2B) and door jamb (9) to retain the second magnetic assembly (1B).

Insertion of the magnetic assemblies is carried out as follows:

1. A drill bit (10A) is used to drill a hole in an edge of the door to a depth greater than measurement B-B of the housing (6A and 6B). In preferred embodiments in which B-B is 8 mm, the minimum depth required will also be 8 mm (i.e. equivalent to the height of the preferred embodiment of housings (6A and 6B). Similarly, as the diameter of housings (6A and 6B) at A-A is 24 mm in preferred embodiments, a 24 mm drill bit is used to install the preferred embodiment of the invention.

It should be appreciated by those skilled in the art that any size housing could conceivably be used with this invention which may require a different size drill bit and/or hole depth to flush mount the housing. Also, it is not essential to flush mount the housing, but it is preferable as it provides for a more aesthetically pleasing finish when installed as previously described. Finally, it should be appreciated that the present example describes mounting the magnet assemblies into the top edge of the door and corresponding part of the door frame or jamb (9). However, it should be appreciated that the assemblies can be installed in any part of the door which abuts a frame or similar immovable object.
2. Housing (6A) is inserted into the hole in the door (8);
3. Combinations of the four spacer washers (3A to 3D) are inserted into the housing between the magnet (2A) in the base of housing (6A) to adjust the height of magnet (2A) relative to the housing (6A) when retained in the assembly via screw (5). For ease of reference and clarity, only two washers are depicted in FIG. 2. In this embodiment, the adjustment mechanism are the spacer washers which are used to adjust the position of the magnet relative to its housing. As will be apparent to those skilled in the art there will be other mechanisms equally effective in achieving the object of adjusting the position of the magnet which could conceivably be used with this invention. Other examples of such mechanisms are described later in the specification.

Figure 7:
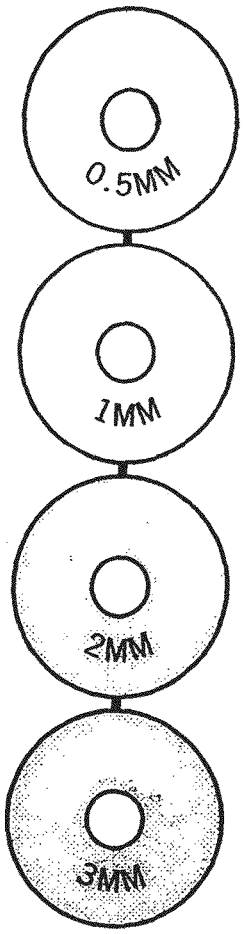
FIG. 7 shows a diagrammatic representation of a set of four spacer washers as supplied in an alternative embodiment of the present invention.

Preferably, the pre-determined range of adjustment is 0.5 to 6.5 mm comprising four spacer washers (3A to 3D) or a set of washers as shown in FIG. 7.

Figure 4:
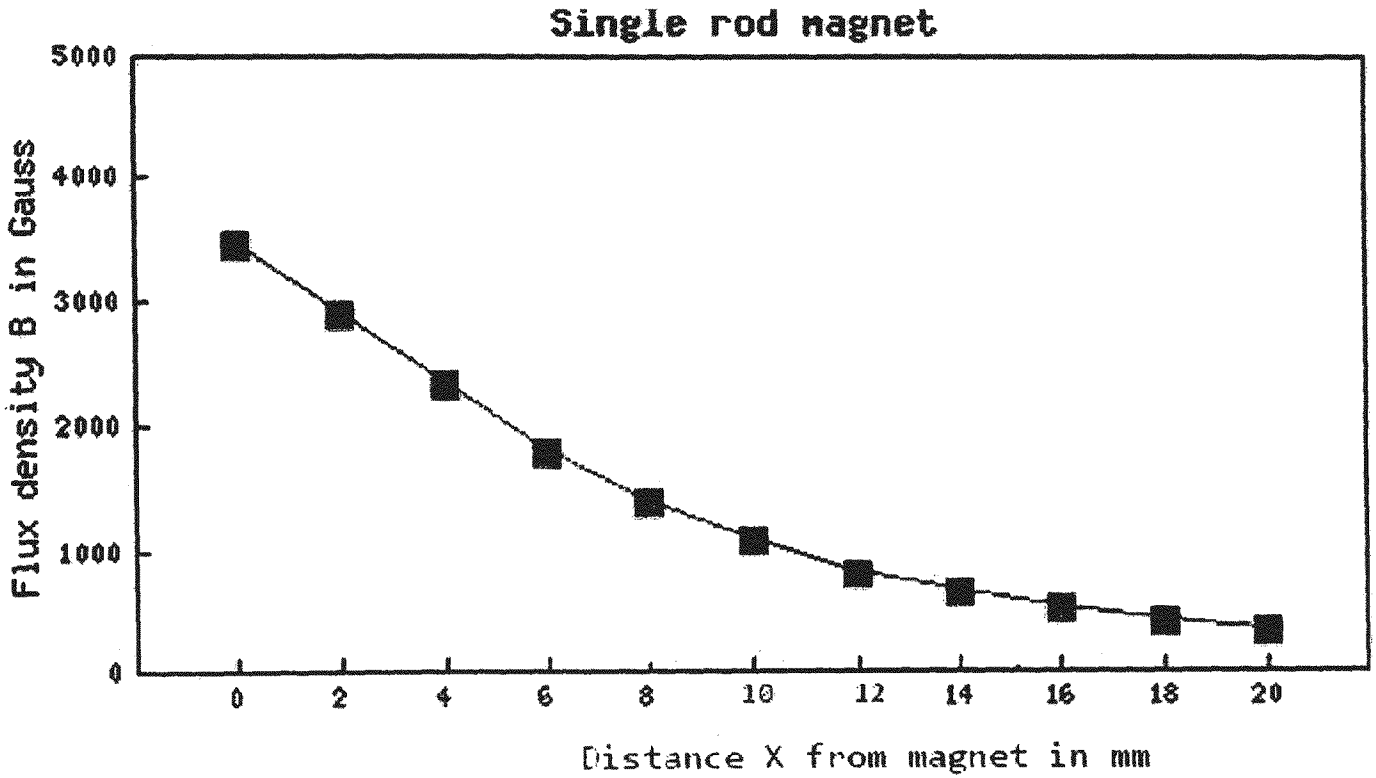
FIG. 4 shows a graph of the magnetic strength or flux density B (measured in Gauss) for a single neodymium (N42 grade) rod magnet in one preferred embodiment of the present invention.

In general, the standard industry gap between a door and a door frame is 3 mm which is an acceptable gap in some situations, but when maximum strength is required, both magnets would be mounted flush in the door and door frame with a minimum gap of 0.5 mm between the magnets, but this is not often practical given the varying gap between a door and frame encountered during installation. The optimum gap distances of 0.5 to 3 mm between the magnets can be determined from assessing the relative magnetic strength properties (Gauss) of the individual magnets and measuring the break force (kg) required to open a door at varying distances (mm) between the two magnets. This information and analysis is shown in the following figures:

FIG. 4 shows a graph of the magnetic strength or flux density (B) measured in Gauss for a single rod neodymium (N42 grade) magnet calculated along the centre axis at varying distances (mm) from the magnet with a diameter of 22 mm and thickness of 8 mm respectively.

The applicant has found that magnets with very strong magnetic strength properties should be used with this invention as the two magnetic components are held together by a magnetic field (as the magnetic components do not actually touch together when the door is closed, as is common with other prior art magnetic catches).

In preferred embodiments, neodymium (N42 grade) magnets are used with this invention. These are sometimes known as 'super magnets'. Sintered neodymium-iron-boron (Nd—Fe—B) magnets are a member of the rare earth magnet family and are one of the most powerful permanent magnets known. An advantage of this type of magnet is that they are very resistant to demagnetisation and can be expected to hold their magnetism for the lifetime of the application. It should be appreciated by those skilled in the art that other types of magnets that have equivalent magnetic strength properties to neodymium magnets could be conceivably used with this invention.

It has been found that magnets manufactured out of ceramic and ferrite (materials used in most magnetic catches) are not suitable for use with this invention as they do not have the magnetic strength properties to perform in the manner required and are also subject to demagnetisation.

Figure 5:
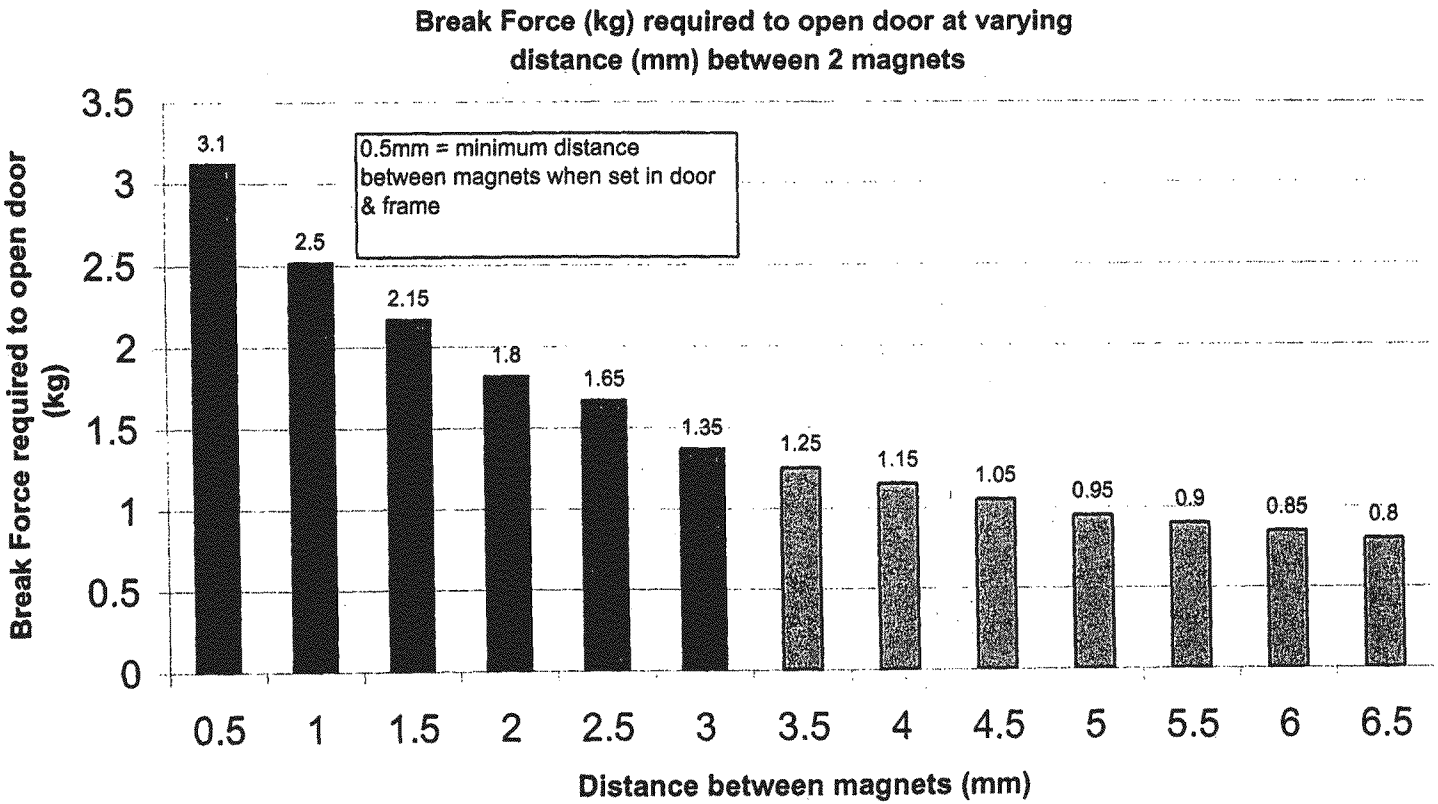
FIG. 5 shows a graph of the break force (measured in kilograms) required to open a door at varying distances (measured in millimeters) between magnetic assemblies of one preferred embodiment of the present invention.

FIG. 5 shows a graph of the break force (kg) required to open the door at varying distances (mm) between the magnets.

Figure 6:
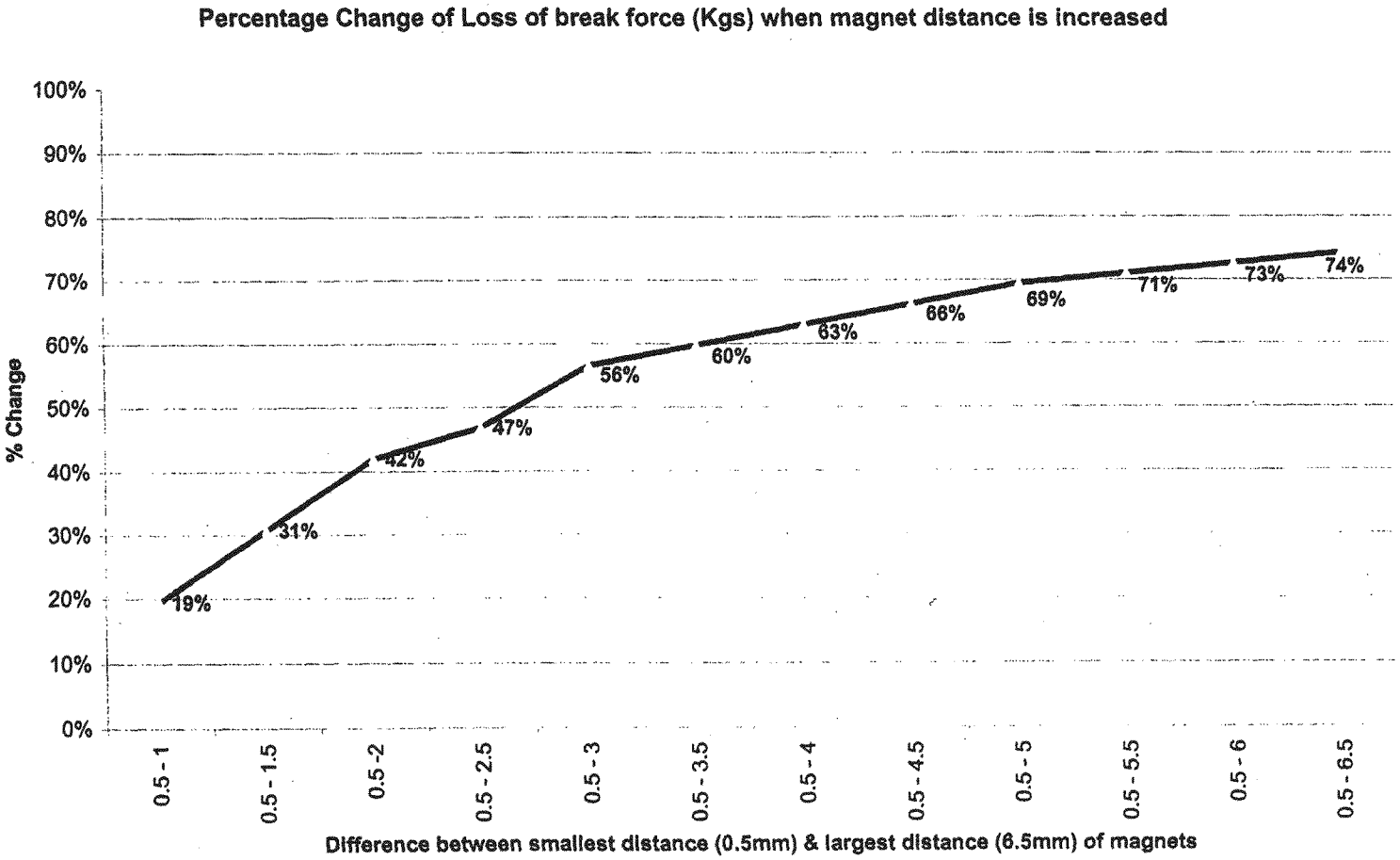
FIG. 6 shows a graph of the percentage change of loss of break force required (measured in kilograms) relative to the distance of the neodymium magnets (measured in millimeters) in one preferred embodiment of the present invention.

FIG. 6 shows a graph of the percentage change of loss of break force required (kg) relative to the increasing distance of the magnets (mm).

For example, the results of the above graphs shows that 3.1 kg of break force is required to open a door when two magnets of 3500 flux density (Gauss) are located at a distance of 0.5 mm from each other.

However, it should be appreciated that any number of spacer washers could conceivably be used with this invention depending on the required range of adjustment.

For example, FIG. 7 shows a diagrammatic representation of a set of four spacer washers which may be supplied with the magnetic assemblies with a thickness ranging from 0.5 mm to 3 mm. This gives a total range of adjustment of up to 6.5 mm. It is envisaged that the set of spacer washers as shown in FIG. 7 are initially connected by plastic tabs which can be easily broken to separate the washers when in use.

It is envisaged that in practice a series of spacer washers of different thicknesses will be supplied with the present invention. This will allow an installer to be able to select from a combination of spacer washers to achieve the desired range of adjustment.

4. The magnet (2A) is then placed on top of the spacer washers (3A to 3D) which have been inserted into the housing (6A) (as described previously) and the components of the magnetic assembly are firmly attached to each other by a self tapping screw (5) which is inserted through aperture (4) in magnet (2A), washers (3A-3D) and housing (6A) into the door. This completes the installation process of the first magnetic assembly (1A).

Once the first magnetic assembly (1A) is installed into the door (8), a corresponding second magnetic assembly (1B) is installed into the frame or door jamb (9) adjacent to the first magnetic assembly (1A) when the door is in its closed position.

The method of installing the second magnetic assembly (1B) is the same as first magnetic assembly (1A) described above. However in the preferred embodiment the second magnetic assembly has no means for adjustment i.e. no spacer washers (3A to 3D). That is because, in the preferred embodiment, where the second assembly is being mounted into a portion of the frame adjacent the top of the door, that assembly will be visible when the door is open. Accordingly, flush mounting the magnet within the housing achieves a more aesthetically pleasing finish than might be attained if the magnet extends from, or recedes into, the housing following adjustment. It will be appreciated by those skilled in the art that to facilitate flush mounting of magnet (2B) into its corresponding housing (6B), the thickness of magnet (2B) will be equivalent to measurement B-B in housing (6B).

It should be further appreciated by those skilled in the art that in alternative embodiments both magnetic assemblies can be provided with a means for adjustment in accordance with the present invention and the lack of adjustment to one assembly in the preferred embodiment should not be seen as a limitation.

When locating magnetic housing (1B) within the frame it is desirable that the housing (1B) is positioned offset from adjacent magnetic housing (1A) when the door is in the close position. More preferably, housing (1B) should be offset towards a surface the door abuts when in the closed position e.g. bump stop (11).

It will be appreciated by those skilled in the art that locating the magnetic assemblies (1A and 1B) in this manner provides a door closure mechanism whereby the adjacent magnets attract each other when the door (8) is at a proximal distance to the door jamb (9). The magnetic forces attract the door (8) to the jamb (9) thereby keeping the door closed and against the jamb (9).

Figure 3:
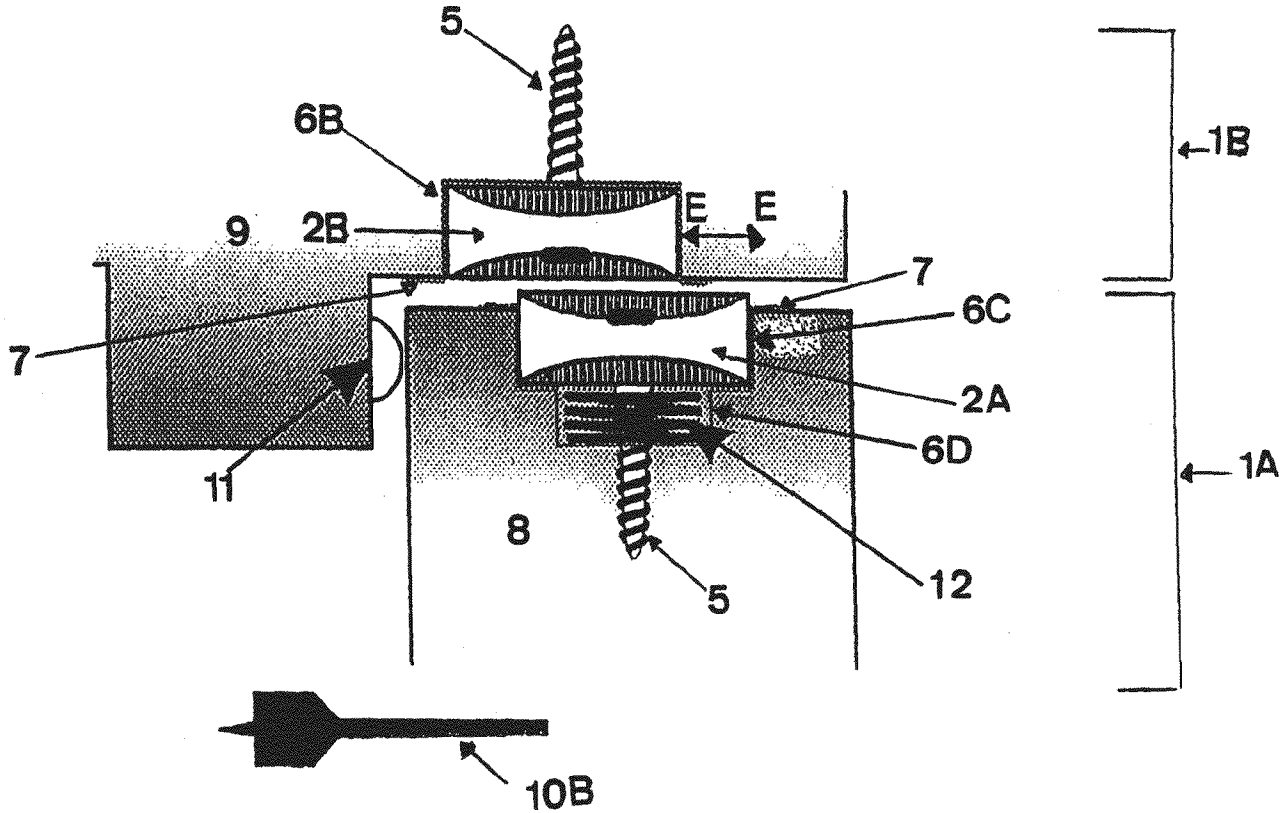
FIG. 3 shows a diagrammatic representation of a cut away side profile view of an alternative embodiment of the present invention wherein the magnetic assemblies have been installed into a door and door frame.

FIG. 3 shows an alternative embodiment of the present invention similar to the embodiment described in FIG. 2 (and therefore need not be described in detail), wherein the means for adjustment of the distance between the magnet (2A) and the housing (6C) is facilitated by a coil spring (12).

FIG. 3 shows a first magnetic assembly (1A) which consists of a coil spring (12) and a housing configured with an upper (6C) and lower (6D) portion. The coil spring (12) is installed and located in the lower portion (6D) of the housing as described below.

The housing is mounted in the door in similar manner to that of the first magnetic assembly (1A) as described previously. However, an additional hole is required to be drilled into the door (8) to accommodate the lower portion (6D) of housing.

Once the housing is inserted into the door (8), the coil spring (12) is positioned inside the lower portion (6D) of the housing. The magnet (2A) is then placed on top of the coil spring (12) and the components of the magnetic assembly (1A) are retained within the housing by a self tapping screw (5) which passes through the aperture of the magnet (1A) and coil spring (12) into the door (8).

As will be appreciated by those skilled in the art, in this configuration spring (12) biases magnet (2A) against the flanged portion of screw (5). If required, an installer can adjust the height of the magnet (2A) by either screwing or unscrewing the screw (5).

The second magnetic assembly (1B) is installed as per the description as outlined and shown in FIG. 2.

It will be apparent to those skilled in the art that there will be other mechanisms or means equally effective in achieving the object of providing adjustment of the distance between the magnet and the housing through a predetermined range.

For example, the base of the housing of the first magnetic assembly may be provided with an upwardly projecting threaded male portion and the aperture (4) of magnet (2A) provided with a corresponding thread such that rotation of the magnet winds the magnet onto or off of the threaded male portion thereby adjusting the height of the magnet (2A) relative to the housing. Similarly, magnet (2A) might be configured with a downwardly projecting male member adapted to be received in a corresponding threaded aperture in housing (2A) and adjusted in the manner previously described.

In all of the above embodiments, once the first and second magnetic assemblies have been installed they provide a closure means for a door, window or the like as the magnetic attraction between the assemblies secure the door to the jamb.

A magnetic assembly configured with a means for adjustment of the distance between the magnet and the housing resolves the problem of providing the correct distance between magnets for the required magnetic power setting. This problem has specifically been rectified by using spacer washers, or a spring biasing mechanism configured with a flanged housing.

There are many advantages associated with this invention such as providing ease of installation, reduced labour time, more precise magnetic strength of door closure and a professional finish when installed.

Some specific features, advantages and problems that this invention overcomes are as follows:

The invention reduces the care required when drilling holes for installation of a magnetic latching assembly in a neat and tidy fashion as to give sufficient holding power large magnets must be used and the holes for locating and housing the magnets must be similarly large. Furthermore, the wood types used for internal joinery are normally soft which often results in an oval hole with chips around the edges rather than a round hole. This leads to a poor quality finish which is visible when the door is opened, but the magnetic housing with flange covers the hole that is recessed into the wood.

The invention eliminates the need to precisely align and drill holes to align magnets as the flange enables the housing to be always mounted square against the door/door jamb surface.

This invention aides the installation of double doors by allowing independent adjustment of the magnets. In double door applications the size of the gap between the door and the frame of one door may differ from that of the other which would result in a different attractive force between the magnets on the respective doors if both were flush mounted.

At present, an installer has to pack the door magnet up with a piece of cardboard or wood to adjust the distance and hence magnetic power which adds to the installation time and especially if a packer of suitable thickness can not be found onsite which increases the installation time.

The invention is versatile as it can be used anywhere a roller latch or equivalent would normally be fitted.

The invention offers ease of installation with minimal labour.

As the magnetic assemblies do not contact each other (after installation), the components are durable and will not wear out.

The magnetic assemblies can be screded over (in gib etc) and painted for complete concealment (e.g. floor to ceiling pivot doors).

There is no latch noise when opening and closing the door (unlike a roller latch).

The magnetic assemblies are completely concealed when the door is closed as there is no unsightly protruding strike plate lip (unlike a roller latch).

Aspects of the present invention have been described by way of example only and it should be appreciated that modifications and additions may be made thereto without departing from the scope thereof as defined in the appended claims.

What I claim is:

1. A door closure system which includes:

a door having two planar parallel faces and four planar edges each perpendicular to the faces;

a door frame;

a first and second magnetic assembly, each of said first and second magnetic assemblies comprising:

a magnet having a central axis; and a housing in which the respective magnet is housed; and wherein the door is hinged to the door frame, and the door frame has at least one abutting surface that the door abuts when the door is in a closed position;

wherein at least one of the first and second magnetic assemblies of the door closure system includes an adjustment mechanism to adjust the position of the magnet relative to its housing, wherein the first magnetic assembly is mounted within a top edge of the door or a side edge of the door, the second magnetic assembly is mounted within the door frame, and, the first magnetic assembly is adjacent but not in contact with the second magnetic assembly when the door abuts the abutting surface of the door frame; and wherein the central axis of the magnet in the first magnetic assembly is aligned substantially perpendicular to the edge of the door within which the first magnetic assembly is mounted; and wherein, when the door abuts the abutting surface of the door frame, the central axis of the magnet in the second magnetic assembly is aligned substantially parallel to the central axis of the magnet in the first magnetic assembly wherein, when the door abuts the abutting surface of the door frame, the central axis of the magnet in the second magnetic assembly is spaced from the central axis of the magnet in the first magnetic assembly in a direction substantially perpendicular to the planar faces of the door and towards the abutting surface of the door frame, such that when the door is closed, the second magnetic assembly exerts an attractive force on the first magnetic assembly in the direction substantially perpendicular to the planar faces of the door and towards the abutting surface of the door frame.

2. A door closure system as claimed in claim 1, wherein the first magnetic assembly includes the adjustment mechanism.

3. A door closure system as claimed in claim 1, wherein at least one of the magnets is circular.

4. A door closure system as claimed in claim 1, wherein at least one of the magnets includes an aperture.

5. A door closure system as claimed in claim 1, wherein at least one of the housings includes a protrusion.

6. A door closure system as claimed in claim 5, wherein the protrusion extends from the top of, and perpendicular to, a side wall of the respective housing.

7. A door closure system as claimed in claim 5, wherein the protrusion is a flange.

8. A door closure system as claimed in claim 1, wherein at least one of the housings includes an aperture.

9. A door closure system as claimed in claim 1, wherein at least one of the housing includes a spacer ring.

10. A door closure system as claimed in claim 1, wherein the adjustment mechanism is at least one washer.

11. A door closure system as claimed in claim 1, wherein the adjustment mechanism is a spring.

12. A door closure system as claimed in claim 1, wherein the magnets of the first and second magnetic assemblies are separated by a gap distance of 0.5 to 3 mm when the door is closed.

13. A door closure system as claimed in claim 1, wherein the adjustment mechanism provides a predetermined range of adjustment between the magnet and its housing is 0.5 to 6.5 mm.

14. A method of installing first and second magnetic assemblies in a door closure system, wherein the door closure system includes:

a door having two planar parallel faces and four planar edges each perpendicular to the faces; and a door frame;

the first and second magnetic assembly, each of said first and second magnetic assemblies comprising:

a magnet having a central axis; and a housing in which the respective magnet is housed;

wherein the door is hinged to the door frame, and the door frame has at least one abutting surface that the door abuts when the door is in a closed position;

wherein at least one of the first and second magnetic assemblies of the door closure system includes an adjustment mechanism to adjust the position of the magnet relative to its housing, wherein the first magnetic assembly is mounted within a top edge of the door or a side edge of the door, the second magnetic assembly is mounted within the door frame, and the first magnetic assembly is adjacent but not in contact with the second magnetic assembly when the door abuts the abutting surface of the door frame; and wherein the central axis of the magnet in the first magnetic assembly is aligned substantially perpendicular to the edge of the door within which the first magnetic assembly is mounted; and wherein, when the door abuts the abutting surface of the door frame, the central axis of the magnet in the second magnetic assembly is aligned substantially parallel to the central axis of the magnet in the first magnetic assembly; and wherein, when the door abuts the abutting surface of the door frame, the central axis of the magnet in the second magnetic assembly is spaced from the central axis of the magnet in the first magnetic assembly in a direction substantially perpendicular to the planar faces of the door, such that when the door is closed, the second magnetic assembly exerts an attractive force on the first magnetic assembly in the direction substantially perpendicular to the planar faces of the door and towards the abutting surface;

the method including the steps of:

a) inserting the housing for the first magnetic assembly into a pre-drilled hole within the door, and inserting the housing for the second magnetic assembly into a pre-drilled hole within the door frame;

b) assembling the first magnetic assembly in the door and the second magnetic assembly in the door frame; and c) adjusting the position of at least one of the magnets in said first and second magnetic assemblies relative to its housing, by manipulation of the adjustment mechanism.

* * * * *